US009796010B2

(12) United States Patent
Hofer et al.

(10) Patent No.: US 9,796,010 B2
(45) Date of Patent: Oct. 24, 2017

(54) METHOD AND DEVICE FOR WINDING A MATERIAL WEB

(71) Applicant: PRIMETALS TECHNOLOGIES AUSTRIA GMBH, Linz (AT)

(72) Inventors: Roland Hofer, Reichenau im Muehlkreis (AT); Friedrich Moser, Hellmonsoedt (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 489 days.

(21) Appl. No.: 14/381,031

(22) PCT Filed: Feb. 7, 2013

(86) PCT No.: PCT/EP2013/052360

§ 371 (c)(1),
(2) Date: Aug. 26, 2014

(87) PCT Pub. No.: WO2013/131701

PCT Pub. Date: Sep. 12, 2013

(65) Prior Publication Data

US 2015/0008276 A1 Jan. 8, 2015

(30) Foreign Application Priority Data

Mar. 7, 2012 (EP) ..... 12158406

(51) Int. Cl.

| | |
|---|---|
| ***B21C 47/34*** | (2006.01) |
| ***B65H 18/20*** | (2006.01) |
| ***B65H 23/032*** | (2006.01) |

(52) U.S. Cl.

CPC ..... *B21C 47/3425* (2013.01); *B65H 18/20* (2013.01); *B65H 23/0328* (2013.01);
(Continued)

(58) Field of Classification Search

CPC B21C 47/3425; B65H 18/20; B65H 23/0328; B65H 2701/173; B65H 2404/15212; B65H 2408/2326

See application file for complete search history.

(56) References Cited

U.S. PATENT DOCUMENTS 2,630,319 A 3/1953 Heilman et al.
3,902,677 A * 9/1975 Wolf ..... B65H 16/08 242/542

(Continued)

FOREIGN PATENT DOCUMENTS

CN 101977833 A 2/2011
CN 102300652 A 12/2011

(Continued)

OTHER PUBLICATIONS

Office Action dated Dec. 2, 2015 issued in corresponding Chinese Patent Application No. 201380012997.6 with English translation.

(Continued)

*Primary Examiner* — William A Rivera
(74) *Attorney, Agent, or Firm* — Ostrolenk Faber LLP

(57) ABSTRACT

Device for winding a material web, particularly a metal strip, wherein a coil (1) is supported during the winding process by at least two support rollers (2, 3), wherein the support rollers (2, 3) can be jointly pivoted about a pivot axis (18) between a first, substantially horizontal, position and a second position, which is inclined relative to the horizontal position, by means of a pivoting device (11).

13 Claims, 4 Drawing Sheets

(52) U.S. Cl.
CPC ..... *B65H 2404/15212* (2013.01); *B65H 2408/2326* (2013.01); *B65H 2701/173* (2013.01)

(56) References Cited

U.S. PATENT DOCUMENTS

| | | | | | |
|---|---|---|---|---|---|
| 4,759,485 | A * | 7/1988 | Braun | B21C 47/34 | 226/176 |
| 5,906,305 | A * | 5/1999 | Knorr | B65H 23/038 | 198/807 |
| 7,588,208 | B2 * | 9/2009 | Stitz | B65H 18/16 | 242/534 |
| 7,967,236 | B2 * | 6/2011 | Jorkama | B65H 18/028 | 242/599 |
| 8,372,245 | B2 * | 2/2013 | Jorkama | B65H 18/00 | 162/198 |
| 2010/0212386 | A1 | 8/2010 | Bocking | 72/176 | |
| 2011/0000948 | A1 | 1/2011 | Fuwa | 226/3 | |
| 2011/0271732 | A1 | 11/2011 | Roese | 72/214 | |

FOREIGN PATENT DOCUMENTS

| | | | |
|---|---|---|---|
| CN | 102344048 | A | 2/2012 |
| CN | 202148079 | U | 2/2012 |
| CN | 2021480748 | U | 2/2012 |
| DE | 102007015636 | A1 | 5/2008 |
| JP | 8-282889 | | 10/1996 |
| KR | 10-2004-0007103 | | 1/2004 |
| KR | 1020040007103 | A | 1/2004 |
| KR | 10-2004-0056824 | | 7/2004 |
| KR | 1020040056824 | A | 7/2004 |

OTHER PUBLICATIONS

Chinese Office Action, dated May 5, 2015, issued in corresponding Chinese Patent Application No. 201380012997.6. English translation. Total 12 pages.
International Search Repot dated May 17, 2013 issued in corresponding International patent application No. PCT/EP2013/052360.
International Preliminary Report on Patentability dated Jul. 1, 2014 issued in corresponding International patent application No. PCT/EP2013/052360.

* cited by examiner

METHOD AND DEVICE FOR WINDING A MATERIAL WEB

CROSS-REFERENCE TO RELATED APPLICATIONS

The present application is a 35 U.S.C. §§371 National Phase conversion of PCT/EP2013/052360, filed Feb. 7, 2013, which claims priority of European Patent Application No. 12158406.4, filed Mar. 7, 2012, the contents of which are incorporated by reference herein. The PCT International Application was published in the German language.

TECHNICAL FIELD

The invention relates to a method and a device for winding a material web, in particular a metal strip, wherein a coil is supported during the winding process by at least two support rollers driven in rotation.

TECHNICAL BACKGROUND

In various industrial production processes a strip-shaped material is wound to form a reel with the aim of achieving an edge alignment as level as possible. In producing metal rolling stock, such as a steel strip or an aluminum strip, the rolling strip emerging from a roll stand is also usually wound to form a coil.

In order to test the quality of a metal strip, a test piece of the metal coil is subjected to an inspection. For this purpose a piece of the rolling strip is unwound from the coil and is wound back on after the test. Here the problem arises that, as the unwound length increases there is a danger that the rolling strip will become misaligned laterally. This results in a telescoped metal coil, at least in the outer windings. Metal strip projecting beyond the front face of the metal coil can then be easily damaged during transportation in subsequent process steps. The overall value of the metal coil can thereby be decreased.

To avoid this problem of lateral misalignment, the length to be unwound might, for example, be limited, or a test piece might be cut off. The former has the disadvantage that the inspection cannot be carried out over the desired length. The latter gives rise to waste material since the severed test piece must be discarded.

DESCRIPTION OF THE INVENTION

It is an object of the present invention to specify a method and a device for winding a strip-shaped material web in such a way that lateral misalignment during rewinding is prevented as much as possible.

This object is achieved for a device by the features disclosed herein and by a method disclosed herein.

According to a basic idea of the invention, by inclining support rollers or base rollers a horizontal force component is generated by the weight of the coil resting on the support rollers and is used to counteract the lateral misalignment of a material web. This is achieved by jointly pivoting the two or more support rollers about a pivot axis between a first, substantially horizontal position and a second position which is inclined with respect to the horizontal position, by means of a pivoting arrangement. In other words, since the axes of the support rollers can be inclined with respect to the horizontal in a direction opposing the lateral misalignment of the strip, the edge alignment of the coil can be maintained during (re-)winding of a metal strip. For example, if the edge of a material web runs out of true with respect to the front face of the coil, the two support rollers are inclined in such a way that the edge of the web is realigned with the front face. In this case the inclination of the support rollers can be effected by lowering one front side with respect to the horizontal, depending on which side of the web edge is running out of true with respect to the front face. However, the inclination of the support rollers may also be effected by lowering one front face of the coil and simultaneously raising the other, in a similar way to a balance beam. In the simplest case the pivoting process may be controlled manually, for example by an operator observing the process during rewinding of the metal strip. If a lateral misalignment of the metal strip is detected visually, a corresponding tilting movement can be initiated by hand via an operating device. In rolling mill technology a metal reel, a so-called coil, can weigh, for example, 40 t. To tilt this weight a suitably arranged drive device capable of exerting the force needed for the tilting movement is required. This force may be generated, for example, by one or more hydraulic piston-cylinder units, or by an electric drive in conjunction with a spindle. It should be mentioned at this point, however, that the axial inclination may also be controlled by a device operating automatically. The weight of a metal coil is used very efficiently to generate a horizontal force component directed oppositely to the deviation of the strip. It is achieved by the axial inclination of the support rollers according to the invention that the front faces are flat after inspection of a metal coil. There are therefore no projecting edges which might be damaged in following process steps or during subsequent transportation of the metal coil.

The essential advantage of the invention can therefore be seen to lie in the fact that the value of the metal coil is not reduced by or after an inspection. A further cost advantage of the invention is that a piece of the metal strip does not need to be cut off and discarded during inspection. Scrap is therefore no longer produced during inspection. The technical implementation of a pivoting arrangement for tilting the axes of rotation of the support rollers can be effected comparatively simply, and largely by using known, commercially available units of relatively low cost.

In a preferred embodiment of the device, and of the method, it is provided that the support rollers can each be pivoted through a pivot angle which can be specified steplessly. A deviation of the material web can thereby be counteracted to a very fine degree. Here, too, the weight is used to prevent a lateral deviation of the strip-shaped material. Compared to a lateral displacement of the support rollers, the pivoting process requires less energy.

It may be advantageous if the pivoting movement is a lowering movement, that is, if the pivot plane generated in each case by the pivoting movement of the axes of rotation of the support rollers is disposed vertically.

An especially preferred embodiment of the invention may be characterized in that the pivoting arrangement has a separate support device in which the at least two rotationally-driven support rollers are mounted rotatably. The support device may be, for example, a metal frame configured in the manner of a balance beam; that is to say that the frame can be pivoted with respect to a pivot axis, being supported, for example, centrally. In this case the pivot axis passes through the crossbeam of the frame. However, it is also possible for the frame to be constructed in such a way that, viewed three-dimensionally, the axes of rotation of the support rollers and the pivot axis cross one another but do not intersect.

As indicated above, in order to be able to carry out the pivoting movement automatically, it may be provided that the edge of the material web running onto the coil is detected by means of a suitable sensor. Such a web edge sensor may operate according to various measuring principles, for example with or without contact, and may be, for example, an ultrasonic sensor or a system operating optically. The web edge sensor delivers positional information which is supplied to the pivoting arrangement. This information is taken suitably into account when specifying the pivot angle. The technical implementation of such a pivoting arrangement includes essentially an information processing unit, for example a computer, which, via corresponding control signals, causes a drive arrangement to generate the pivoting movement. Both items are in principle commercially available, can be suitably adapted with small expenditure and therefore do not need to be explained in detail here.

BRIEF DESCRIPTION OF THE DRAWINGS

For further clarification of the invention, in the following part of the description reference is made to drawings from which further advantageous configurations, details and developments of the invention can be derived in application to a non-restrictive exemplary embodiment. In the drawings.

DESCRIPTION OF EMBODIMENTS

Figure 1:
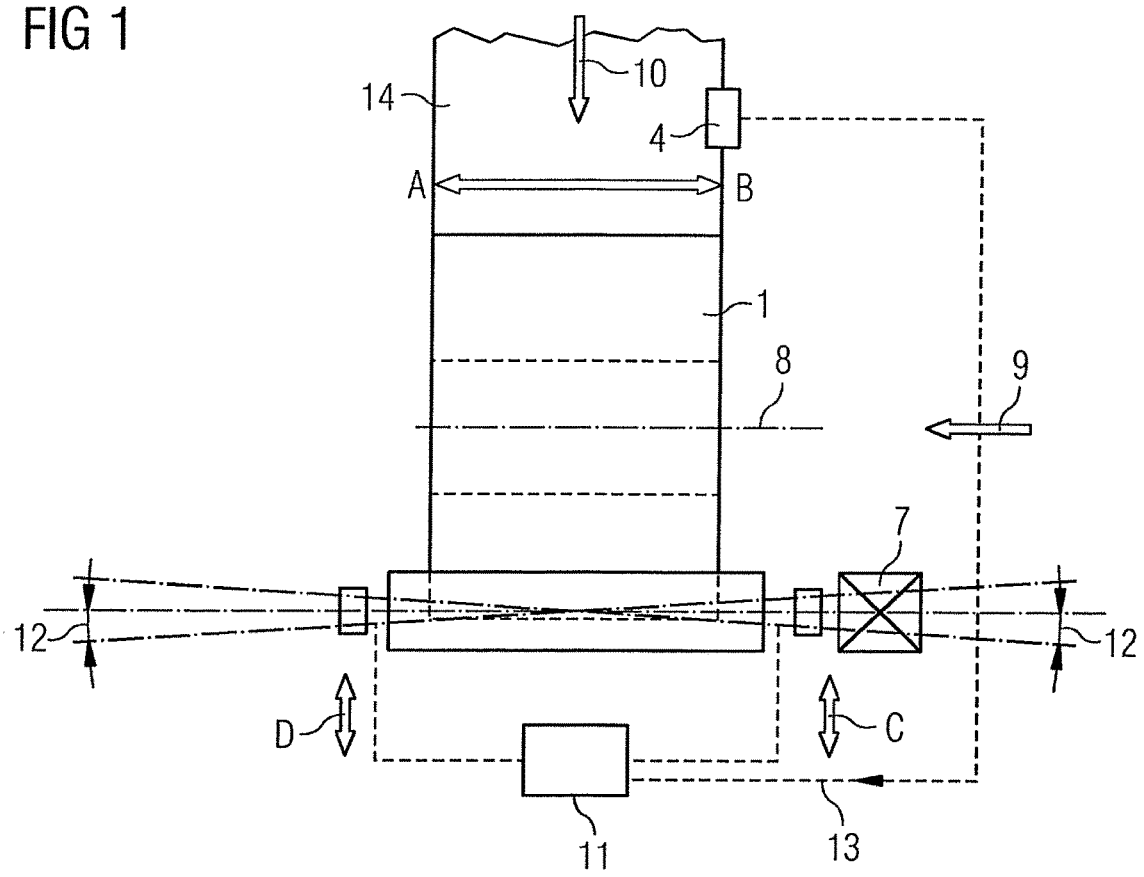
FIG. 1 is a schematic representation of the device according to the invention in a first view.
Figure 2:
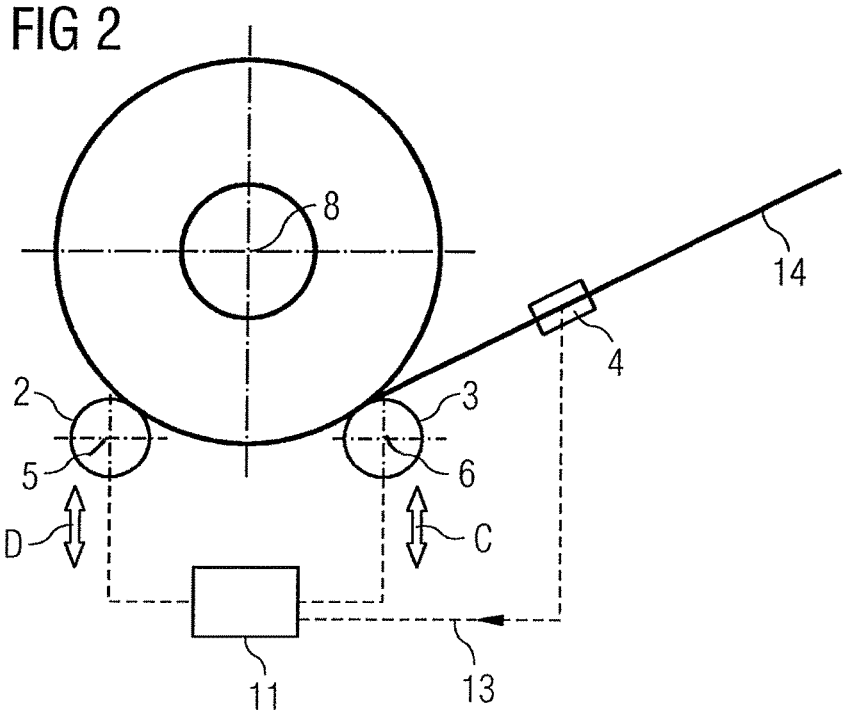
FIG. 2 shows the representation in FIG. 1 viewed from a side.

FIG. 1 and FIG. 2 show the principle of the present invention in a schematic representation. The representation shows the situation of a coil 1 resting on two support or base rollers 2, 3. Such a coil may be, for example, a metal coil. It should be assumed that a piece of a material web 14, also referred to hereinafter as metal strip, rolling strip or rolling stock, has been previously wound off for the purpose of inspection and is now to be wound back on. A rotary drive 7 sets the two rollers 2, 3 in rotation. The metal strip 14 therefore runs in the strip feed direction 10 onto the rotating metal coil 1. As this happens an undesired lateral deviation of the metal strip 14 may occur, as described in the introduction. This results in telescoping of the metal coil 1, which is undesired since projecting edges, which can be damaged to the detriment of the value of the metal coil, are produced.

Guidance of the material web 14 running onto the coil 1 can prevent this. According to the invention, this guidance of the strip is effected in such a way that the support or base rollers 2 and 3, which form a so-called "winding trough" or "winding bed" for the metal coil 1, can be lowered or raised at the head end or the foot end. By means of this adjustment very good edge alignment of the metal coil 1 can be achieved. As will be explained in more detail below, the strip guidance may in principle be controlled manually or automatically.

For example, if a lateral deviation of the rolling strip 14 occurs, in either direction A or B, the coil's own weight is used to adjust the running direction of the strip. This is effected by pivoting the "winding trough" or "winding bed", that is, lowering or raising it on one side, by means of a pivoting arrangement 11. This is indicated by the double-headed arrows D and C in FIGS. 1 and 2. As this happens each axis of rotation 5, 6 is pivoted through the pivot angle 12. This has the result that the coil axis 8 is also inclined. In FIG. 1 the arrow 9 shows a movement of the metal coil 1 directed towards the left, which is caused by the weight of the metal coil 1 in that the left-hand bearing side of the support rollers 2, 3 has previously been lowered according to the arrow D.

The force for the pivoting movement in the direction of the arrow D may be generated in different ways, for example hydraulically or electrically.

If, in another example, the rolling strip 14 deviates in the direction A of the double-headed arrow AB, both support rollers 2, 3 are lowered in the direction of the arrow C. (Conversely, in the case of a deviation of the strip in direction B, the support rollers 2, 3 are pivoted down in the direction of the arrow D.)

As a result, the lowering movement on the left or the right side required in the event of adjustment allows good edge alignment to be restored on the front faces of the metal coil 1. During production of a rolling strip 14, therefore, telescopic deviation no longer occurs after the inspection, in which a portion of the rolling stock 14 is unwound and is then wound back onto the metal coil 1 after the inspection. There are therefore no projecting web edges of the rolling stock which might be damaged during further handling of the metal coil 1.

If the edge of the material web 14 does not deviate during a (re-)winding process, the horizontal orientation of the support rollers 2, 3 is substantially maintained, as there is no reason for adjustment or guidance.

In the present example, the axes of rotation 2, 3 of the two support rollers 5, 6 run parallel to one another and lie in a horizontal plane. The lowering movement of the support roller axes 5, 6 on one side takes place synchronously in the present exemplary embodiment; that is to say that the pivot angle passed through per time unit is equal for both support rollers 2, 3.

As already stated, guidance of the rolling strip may be controlled manually or automatically. The drawings of FIG. 1 and FIG. 2 indicate an automatic strip guidance system using a web edge sensor 4, the sensor signal 13 of which is supplied to the pivoting arrangement 11. The pivoting arrangement 11 includes a suitable signal processing unit. This uses the sensor signal 13 as the adjustment signal for a drive arrangement, not illustrated in detail in FIGS. 1 and 2.

Figure 3:
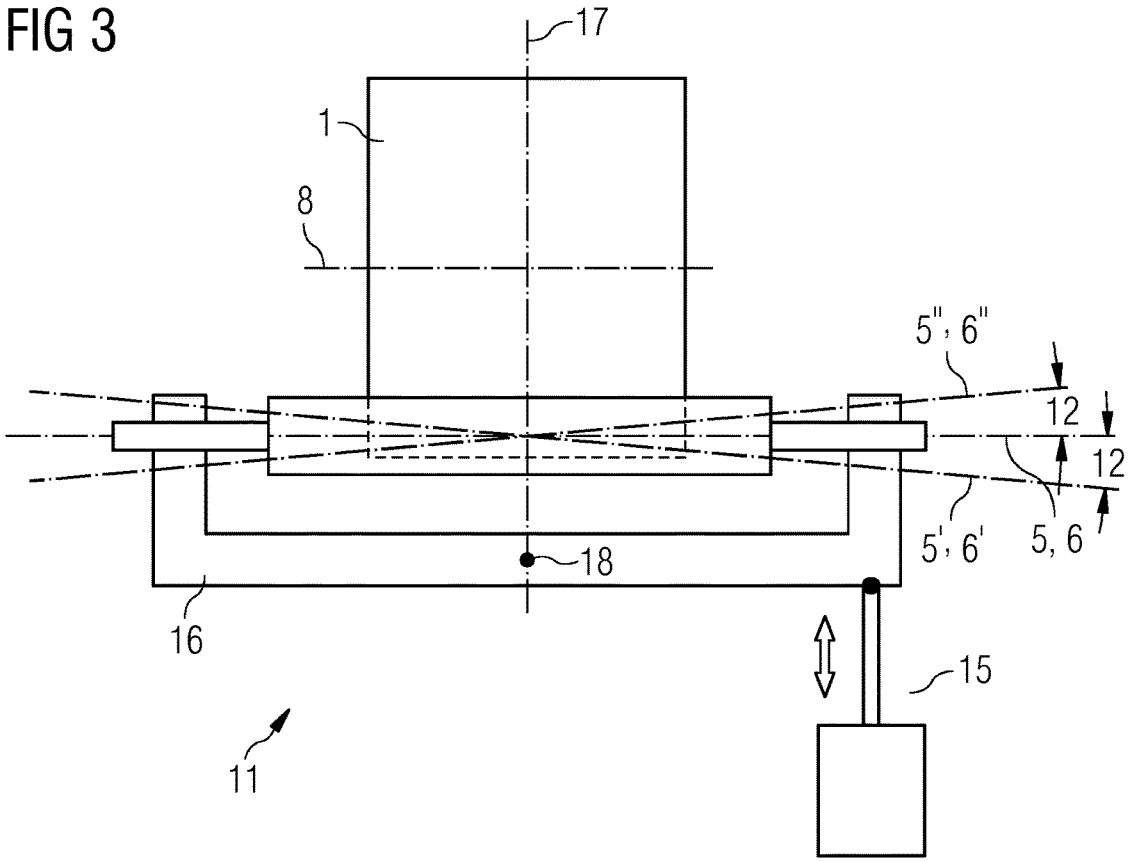
FIG. 3 is a schematic representation of an embodiment of the invention in which the support rollers are mounted rotatably in a frame part configured as a balance beam, and in which the frame part can be pivoted about a pivot axis by means of a drive arrangement.

FIG. 3 shows a possible embodiment of the invention in which the axes of rotation 5, 6 of the support rollers 2, 3 are mounted rotatably in respective frame parts at each end of a support device 16 in the form of a balance beam. The frame part 16 is rotatable about a pivot axis 18. This movement is generated by means of a pivot drive 15, in the present example a piston-cylinder unit engaging with the right side of frame part 16 and moving either up or down on this side. This pivoting movement, in which the two axes of rotation 5, 6 are displaced to respective positions 5', 6' or 5", 6", produces an uphill or downhill orientation for the metal coil 1, depending on the viewing direction. The coil axis 8 runs parallel to the inclination of the axes of rotation 5', 6' or 5", 6". Following gravitational force, the coil 1 will move to the downhill side, whereby its weight can be utilized in guiding the metal strip 14 and a lateral deviation can be efficiently counteracted.

The constructional implementation of the pivoting arrangement 11, which consists essentially of the frame part 16 and the drive unit 15, does not need to be discussed in detail here, since these units can be assumed to be known or commercially available. It should again be pointed out here that the pivoting arrangement 11 can be operated both manually and automatically.

In the embodiment shown in FIG. 3 the pivot axis 18 lies symmetrically on the line of an axis of symmetry 17 which defines a central region of the winding apparatus. As explained below, however, this is not necessarily the case.

Figure 4:
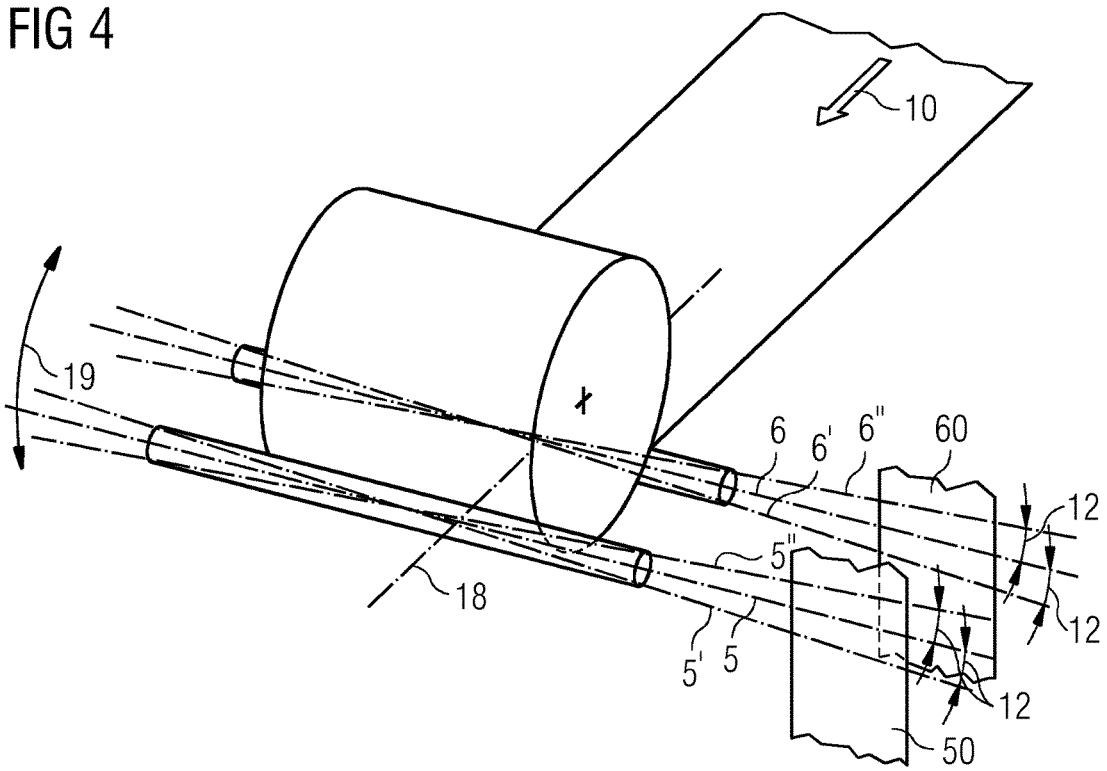
FIG. 4 is a schematic sketch showing a metal coil on two support rollers in a three-dimensional representation.

In FIG. 4 this is illustrated once more in a three-dimensional representation. The pivoting movement through the pivot angle 12, indicated by the arrow 19, takes place in vertical pivot planes 50, 60.

Figure 5:
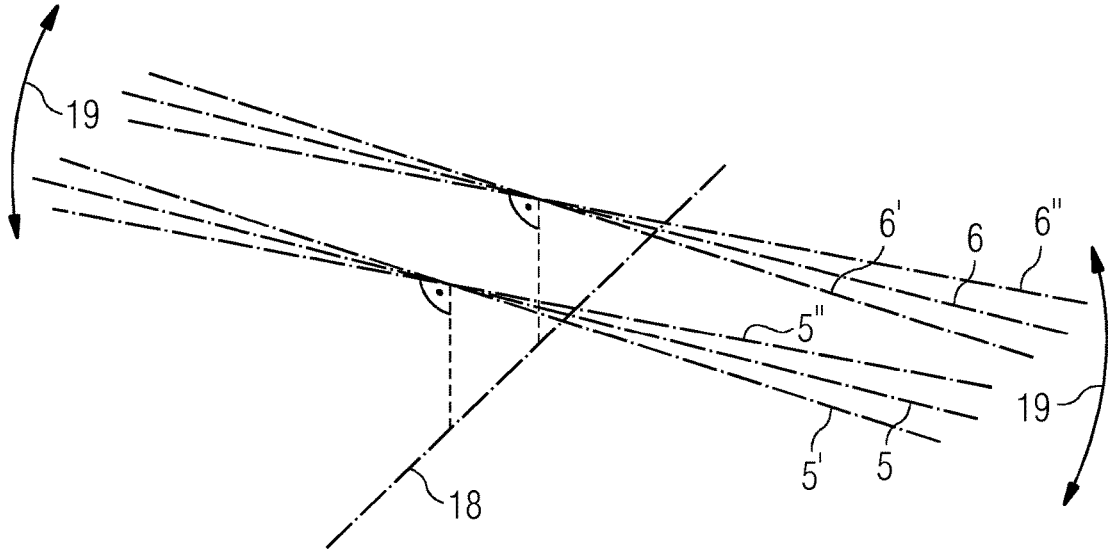
FIG. 5 shows a possible arrangement of the two axes of rotation in relation to the pivot axis according to FIG. 4.

FIG. 5 shows the arrangement of the two axes of rotation 5, 6 with respect to the pivot axis 18 as shown in the exemplary embodiment of FIG. 4. The pivot axis 18 does not intersect the two axes of rotation 5, 6 but is located at a vertical distance therefrom. The double-headed arrow 19 again indicates the pivoting movement whereby the axial inclination is adjustable steplessly between the positions 5', 6' and 5", 6".

Figure 6:
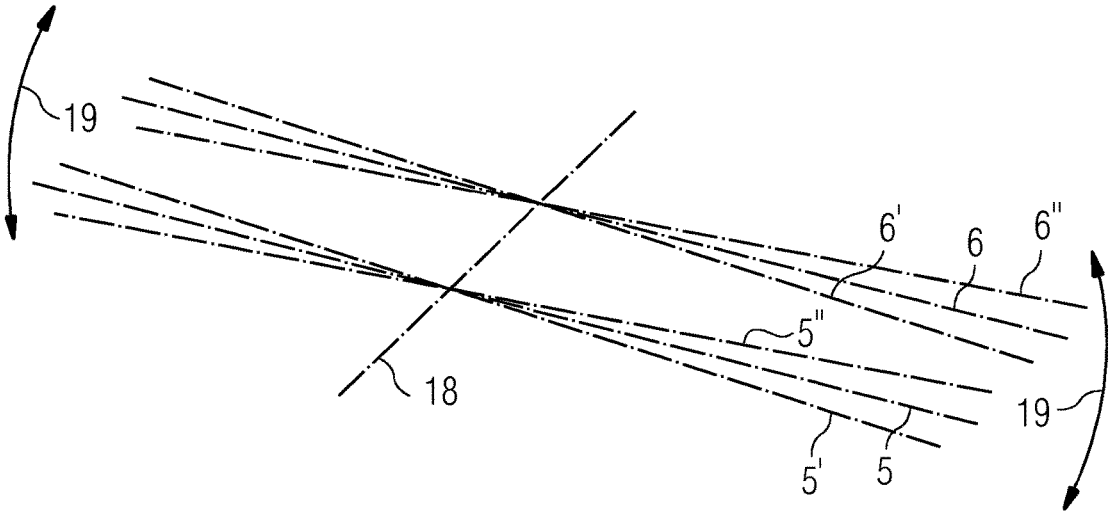
FIG. 6 shows another possible arrangement of two axes of rotation in relation to a pivot axis.

In deviation from FIG. 5, the sketch in FIG. 6 shows another possible exemplary embodiment, in which the pivot axis 18 intersects the axes of rotation 5, 6. Here, too, each of the two axes of rotation 5, 6 again can be adjusted steplessly between the positions 5', 6' and 5", 6".

In the examples shown above, the two axes of rotation 5, 6 run parallel to one another and are located approximately in a horizontal plane. However, this is not necessarily the case. It also appears possible that, although the two axes of rotation 5, 6 run parallel to one another, they may be at different distances with respect to the pivot axis 18.

The pivoting movement may be effected in that the opposite front side is lowered or raised. However, the pivoting movement may also take place in the manner of a balance beam, the lowering of one side causing the raising of the other side.

In the case of automatic control of the support rollers, the detection of the web edge which is required for this method may be implemented in different ways, for example with or without contact.

Although the invention has been illustrated and described in detail with reference to the preferred exemplary embodiment, the invention is not limited to the examples disclosed and other variations can be derived therefrom by the person skilled in the art without departing from the protective scope of the invention.

Thus, the pivoting arrangement 11 may the configured in various ways, for example as a hydraulic drive and/or an electric drive. The lowering movement may be implemented by means of a spindle or using a different mechanism. Self-evidently, a plurality of support rollers may be used instead of the support by means of two support rollers described here. The drive of the pivoting frame may, of course, also be effected by a plurality of linear drives engaging at respective ends in the region of the bearings of the support rollers. It is also possible for the pivoting movement to be generated by a rotary drive.

As was emphasized in the preceding explanations of the examples, a preferred field of application of the invention concerns the winding of a metal strip, in particular during inspection or removal of a sample.

Self-evidently, however, the invention is not restricted to this exemplary application of rewinding a metal strip, but can be used in principle for the winding process of any material web, such as a plastics or paper web or a web of textile or another material.

SUMMARY OF THE REFERENCES USED

1 Coil, metal coil
2 First support roller
3 Second support roller
4 Web edge sensor
5,5',5" Position of axis of rotation of first support roller
6,6',6" Position of axis of rotation of second support roller
7 Rotary drive
8 Coil axis
9 Arrow
10 Feed direction of strip
11 Pivot arrangement
12 Pivot angle
13 Sensor signal
14 Material web, metal strip
15 Pivot drives
16 Support device
17 Axis of symmetry
18 Pivot axis
19 Arrow
50, 60 Pivot plane

The invention claimed is:

1. A device for winding a metal strip, comprising:

a coil on which the metal strip being wound is supported during a winding process;

at least two support rollers on which the coil is supported during the winding process, the support rollers being pivotable jointly about a pivot axis, the pivot axis extending in a direction across a direction of a respective roller axis of each of the at least two support rollers, the at least two support rollers being pivotable jointly between a first, substantially horizontal orientation and a second orientation which is inclined with respect to the horizontal orientation; and a pivoting arrangement configured for pivoting the at least two support rollers such that respective pivot planes generated by respective pivoting movements of the axes of rotation of the at least two support rollers are vertical;

wherein the pivoting arrangement includes a support device in which the at least two support rollers are mounted rotatably.

2. The device as claimed in claim 1, wherein the pivoting arrangement is configured for steplessly pivoting the at least two support rollers through a pivot angle which can be specified.

3. The device as claimed in claim 1, further comprising an edge sensor configured and located to sense an edge of the metal strip incoming toward the coil; and wherein the pivoting arrangement is configured to take account of positional information provided by the edge sensor.

4. The device as claimed in claim 3, wherein the edge sensor is located generally at an edge of the metal strip incoming toward the coil.

5. The device as claimed in claim 1, wherein the support device is configured as a balance beam and the pivot axis is spaced at a distance below each of the axes of rotation of the at least two support rollers.

6. The device as claimed in claim 1, wherein the support device supports the at least two support rollers at a pivot axis located toward a same respective end of each of the at least two support rollers, and the support device supports the at least two support rollers for pivoting around the pivot axis toward the same respective end of each of the at least two support rollers.

7. A method for winding a metal strip on a coil, the method comprising:

supporting the coil on at least two separated rotatable support rollers, each roller of the at least two support rollers being rotatable about a respective roller axis;

supporting the at least two support rollers, by a support device, to rotate and also supporting the at least two support rollers, by the support device, to pivot from a horizontal orientation to an orientation tilted from the horizontal orientation by pivoting the at least two support rollers around a pivot axis;

winding the metal strip onto the coil supported on the at least two support rollers;

determining that the metal strip incoming to the coil is offset in a direction along an axis of the coil from a desired axial position of the metal strip as it is incoming to the coil; and pivoting the at least two support rollers around the pivot axis that extends in a direction across the direction of each of the at least two support rollers, wherein the pivot axis of the at least two support rollers enables pivoting of the at least two support rollers between a substantially horizontal orientation and an inclined orientation which is inclined with respect to the horizontal, the orientation of the pivoting of the at least two support rollers is selected for causing return of the metal strip along the axis of the coil to a selected location of the coil; and the pivoting of the at least two support rollers is in respective pivot planes with a vertical rotation component in which the at least two support rollers pivot.

8. The method as claimed in claim 7, further comprising steplessly pivoting each of the at least two support rollers through a respective pivot angle.

9. The method as claimed in claim 7, further comprising sensing the position of the metal strip along an axis of the coil by sensing an edge of the metal strip as it is incoming toward the coil and providing positional information regarding the edge of the metal strip near the incoming metal strip onto the coil; and setting the pivot angle of the at least two support rollers based on the positional information.

10. The method as claimed in claim 7, wherein the support device is configured and operable to pivot the at least two support rollers around the pivot axis and the pivot axis is located between and away from opposite ends of the at least two support rollers.

11. The method as claimed in claim 7, wherein the pivot axis is at a distance from the rotation axes of the at least two support rollers and spaced away from the coil supported on the at least two support rollers.

12. The method as claimed in claim 7, wherein the support device pivots the at least two support rollers around the pivot axis and the pivot axis intersects the axes of rotation of the at least two support rollers.

13. The method as claimed in claim 7, wherein the at least two support rollers are supported toward a same respective end of each of the at least two support rollers, and the method further comprises pivoting each of the at least two support rollers around the pivot axis, which is located toward the same respective end of each of the at least two support rollers.

* * * * *